United States Patent [19]

Heitman

[11] 4,043,061

[45] Aug. 23, 1977

[54] GROUND-SHAPING SYSTEMS FOR A BACKHOE BUCKET

[76] Inventor: LeRoy Marvin Heitman, 28900 Ironwood, Sunnymead, Calif. 92388

[21] Appl. No.: 678,870

[22] Filed: Apr. 21, 1976

[51] Int. Cl.[2] ..... E02F 5/02

[52] U.S. Cl. ..... 37/141 R; 37/DIG. 12; 214/145 R; 403/362

[58] Field of Search ..... 37/DIG. 3, DIG. 12, 37/DIG. 16, 103, 80 A, 118 R, 118 A, 117.5, 141 R, 142 R; 403/236, 362, 254; 214/145 R

[56] References Cited

U.S. PATENT DOCUMENTS

| | | | |
|---|---|---|---|
| 1,271,596 | 7/1918 | Mayer | 403/362 X |
| 2,864,184 | 12/1958 | Fohr | 37/142 R |
| 3,000,120 | 9/1961 | Larve et al. | 37/103 |
| 3,792,539 | 2/1974 | Clark | 37/103 X |

FOREIGN PATENT DOCUMENTS

| | | | |
|---|---|---|---|
| 1,210,482 | 9/1959 | France | 403/362 |
| 2,251,896 | 5/1973 | Germany | 37/195 |
| 168,818 | 10/1959 | Sweden | 37/118 R |

*Primary Examiner*—Clifford D. Crowder
*Attorney, Agent, or Firm*—Harvey C. Nienow

[57] ABSTRACT

A ground-shaping system attachable to and usable with a back-hoe bucket to shape the upper portions of a ditch to be formed, and to provide flexibility in affording many alternatives. It comprises two, three or more ground-cutting members and clamp means for securing said members relative to the side wall of a back-hoe bucket, there being a back plate for cooperating with the bucket side wall to remove the ground cut by the cutting members.

7 Claims, 15 Drawing Figures

FIG. 7
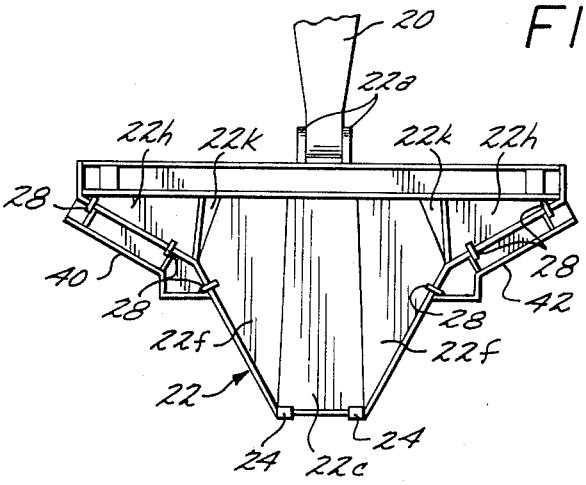
FIG. 8
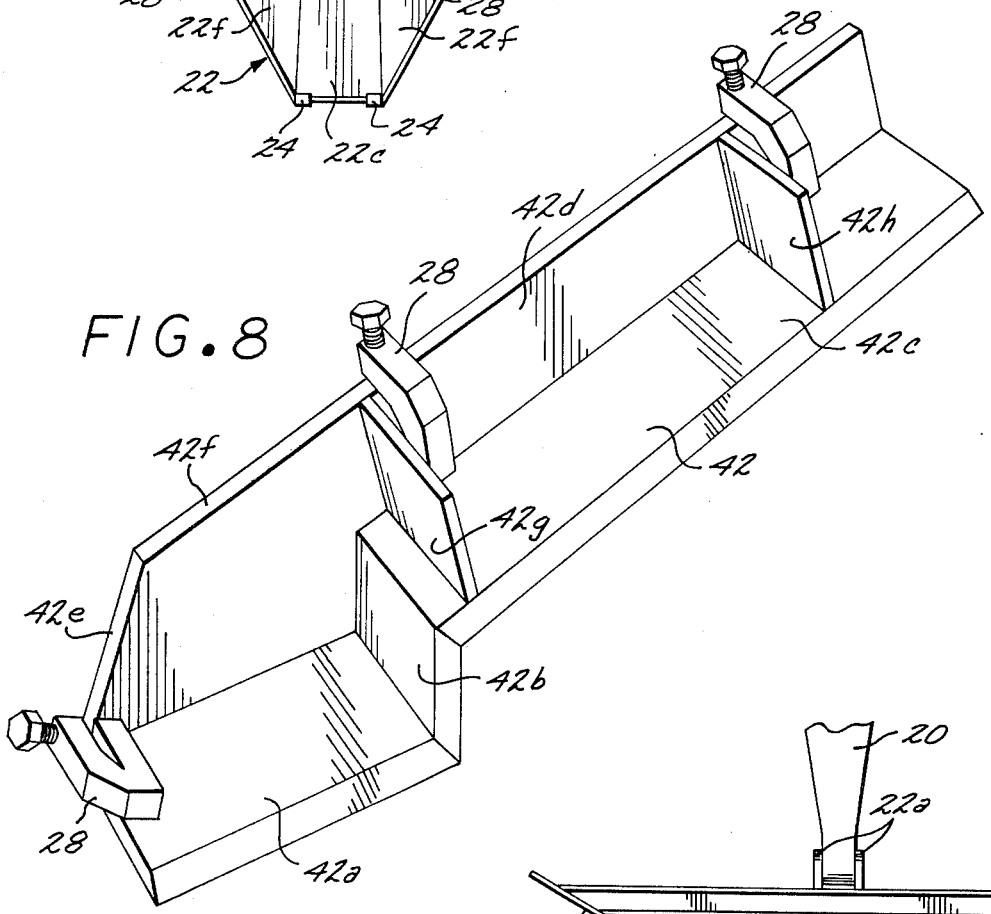
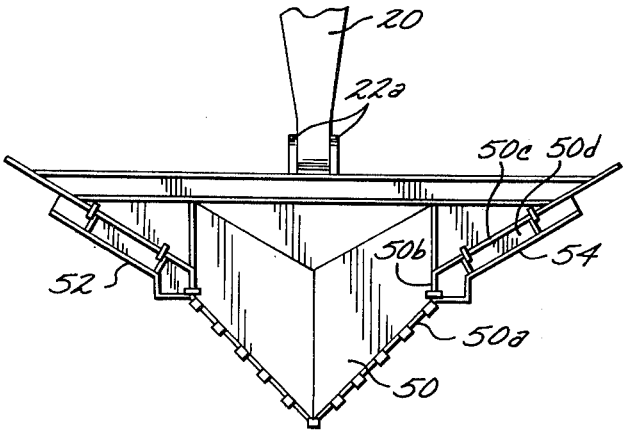
FIG. 10
FIG. 9
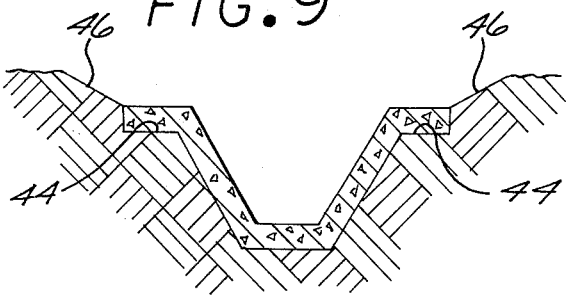

GROUND-SHAPING SYSTEMS FOR A BACKHOE BUCKET

The present invention relates generally to ground-shaping systems, and more particularly to means for digging ditches or trenches having certain predetermined shapes.

Ditches or trenches of widely differing sizes and shapes are necessary for the control of the flow of surface water. That is, to properly utilize hillside building sites, it is desirable, if not mandatory, to provide drainage ditches for systematically removing rain and other surface water without detrimental errosion. To accomplish this, both longitudinal and lateral ditches are dug to conduct the water from the top of the hillside to the bottom thereof.

Typically, a back-hoe is employed for cutting such ditches. However, the size and the shape of drainage ditches vary considerably such that a great many different types and styles of back-hoe buckets have been required. As a result, it has been realized for some period of time that it would be desirable to have means whereby adjustments could be made to vary the shape of a given back-hoe bucket.

Accordingly, it is an object of the present invention to provide a detachable ground-shaping system for use with back-hoe buckets to enable them to cut and shape substantially any desired cross-sectional shape of ditch.

It is another object of the present invention to provide a detachable ground-shaping system as characterized above wherein by interchanging parts or relocating them along the slanting side walls of a back-hoe bucket, the size and shape of the ditch to be cut can be changed.

A still further object of the present invention is to provide a ground-shaping system as characterized above which includes a device having a main body with at least two ground-cutting members disposed at an angle to each other, and wherein C-shaped clamps are employed for securing such device to a side wall of a back-hoe bucket.

An even further object of the present invention is to provide a detachable ground-shaping system as characterized above wherein several ground cutting members are disposed at substantially right angles to each other and wherein a back plate is provided having an angularly disposed edge which when caused to engage the slanting side wall of the back-hoe bucket, causes said ground-cuttig members to be disposed horizontally and vertically, respectively.

An even further object of the present invention is to provide a detachable ground-shaping system as characterized above which can be relocated along the slanting side wall of the bucket to thereby relocate the uppermost edge of the ditch or trench to be provided.

A still further object of the present invention is to provide a detachable ground-shaping system as characterized above which is simple and inexpensive to manufacture, and which is rugged and dependable in operation.

The novel features which I consider characteristic of my invention are set forth with particularly in the appended claims. The invention itself, however, both as to its organization and mode of operation, together with additional objects and advantages thereof, will best be understood from the following description of specific embodiments when read in connection with the accompanying drawings, in which:

FIG. 7 is a fragmentary front elevational view of a back-hoe bucket adapted with a pair of ears;

FIG. 8 is a perspective view of one of the ears of FIG. 7;

FIG. 9 is a cross-sectional view of a concrete-lined ditch formed by the device of FIG. 7;

FIG. 10 is a fragmentary elevational view showing a bucket having a second embodiment of the ear shown in FIG. 8;

Like reference characters indicate corresponding parts throughout the several views of the drawings.

Figure 1:
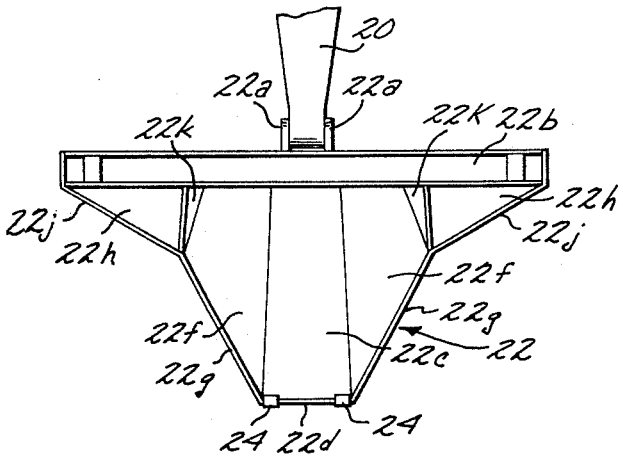
FIG. 1 is a fragmentary front elevational view showing a typical back-hoe bucket attached to a support arm therefor.

Referring to FIG. 1 of the drawings, there is shown therein the end portion 20 of a boom or the like of a back-hoe (not shown), and to which is attached a back-hoe bucket 22. Such bucket is pivotally secured to the end of boom 20 by a pin connection including brackets **22*a***.

Figure 2:
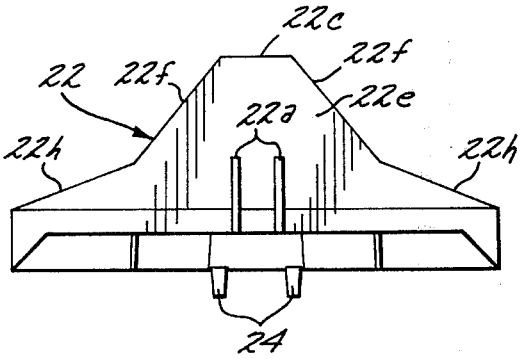
FIG. 2 is a top elevational view of the bucket shown in FIG. 1.

The bucket 22 is formed of sheet metal or the like and includes a rigid steel I-section **22*b* which carries the mounting brackets 22*a*. Attached to such I-section is an arcuately-shaped central section 22*c* which extends from a forward cutting edge 22*d* rearwardly to a top wall 22*e* as shown in FIG. 2. Angularly disposed side sections 22*f* extend from the forward cutting edge 22*g* to the top plate 22*e*. Also, end sections 22*h* extend from a forward edge 22*j* to the top plate 22*e* to complete the open-side nature of the bucket 22. For support and reinforcement purposes, plates 22*k* are provided as shown, between each side wall of the bucket 22 and the top wall 22*e*. One or more cutting teeth 24** may be attached to the cutting edge of the bucket to facilitate insertion of the bucket into the ground as will hereinafter appear.

Figure 3:
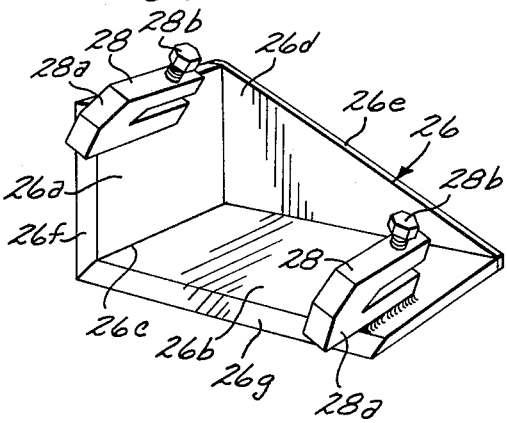
FIG. 3 is a perspective view of a bolt-on-key for use on the bucket of FIGS. 1 and 2.

Referring to FIG. 3 of the drawings, there is shown therein a bolt-on-key 26 which comprises two cutting members **26*a* and 26*b* which are firmly secured to each other as shown at 26*c*. Such bolt-on-key 26 further comprises a back plate 26*d* which is secured to the aforementioned cutting members 26*a* and 26*b*, and which is formed with an angularly disposed edge 26*e* for purposes which will be hereinafter explained. The various members 26*a*, 26*b* and 26*d*** are preferably rigidly secured to each other as by welding or the like to provide an extremely strong and rigid unitary structure.

The forward or leading edges 26f and 26g of members 26a and 26b respectively, may be beveled or tapered to facilitate their cutting into the ground as will hereinafter become more apparent.

The cutting members 26a and 26b are preferably disposed at right angles to each other, and each is provided with a generally C-shaped fastening clamp 28. Each clamp 28 comprises a generally C-shaped body 28a and a fastening bolt 28b which is threadedly secured in one arm of the body. Each such clamp is firmly welded to the respective cutting member, with the slot or opening in the C-shaped body 28a being aligned along a plane paralleling the edge 26e of back plate 26d.

Figure 4:
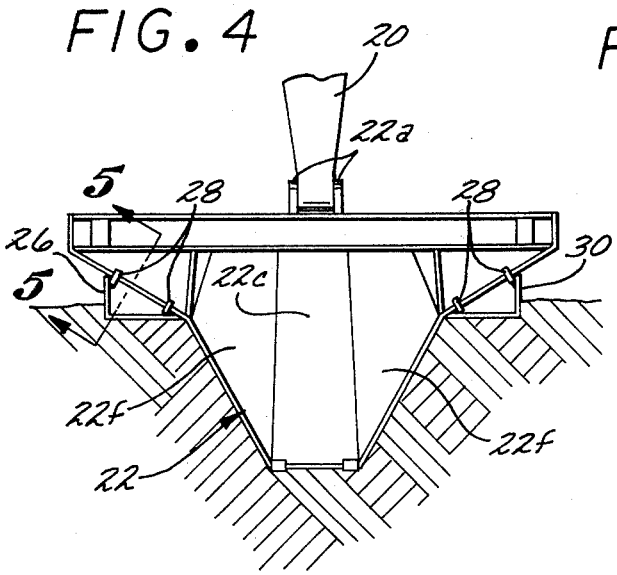
FIG. 4 is a fragmentary front elevational view showing the back-hoe bucket adapted with a pair of bolt-on-keys.

As shown most clearly in FIG. 4 of the drawings, the bolt-on-key of FIG. 3 is attached to the side wall of bucket 22, by securing the clamps 28 to the leading or cutting edge 22j of one of the end sections 22h. The opposite side of the bucket 22 is provided with another bolt-on-key 30 which is the mirror image of the aforedescribed bolt-on-key 26.

Figure 5:
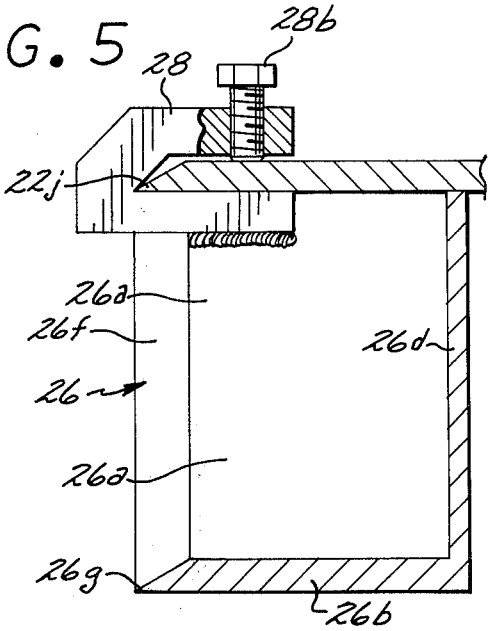
FIG. 5 is a fragmentary sectional view taken substantially along line 5-5 of FIG. 4.

As shown most clearly in FIG. 5 of the drawings, the bolt-on-key 26 when properly secured to the side wall of bucket 22, causes the leading or cutting edge 26g of cutting member 26b to be vertically aligned with the cutting or leading edge 22j of the respective end section 22h.

Figure 6:
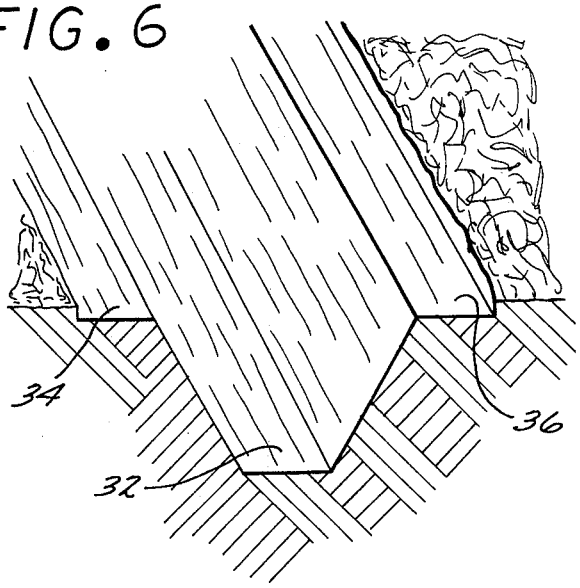
FIG. 6 is a perspective view of a ditch dug by the device shown in FIG. 4.

As shown in FIGS. 4 and 6 of the drawings, as the bucket is drawn through the ground, the main portion of the bucket 22 forms the main portion 32 of the ditch, while the bolt-on-keys 26 and 30 dig the upper opposite edges of the ditch, as shown at 34 and 36.

Referring to FIG. 7 of the drawings, the bucket 22 as described above with respect to FIG. 1, is shown therein as having a pair of oppositely disposed ears 40 and 42. These ears are mirror images of each other, and the ear 42 is shown in detail in FIG. 8 of the drawings.

Ear 42 comprises three angularly disposed cutting members 42a, 42b and 42c firmly secured to each other as by welding or the like. The members 42a and 42b are secured at generally right angles to each other, and the member 42c is secured to 42b at an angle determined by the configuration of the side wall of the back-hoe bucket 22.

A back plate 42d is secured to the cutting members along their rear edges, and is provided with edge sections 42e and 42f which mate against the several sections of the side wall of bucket 22. That is, the edge sections 42e and 42f are disposed at an angle to each other to effectively conform to both of the sections of the respective bucket side walls and so as to dispose cutting member 42a in a generally horizontal position and cutting member 42b in a generally vertical position. At the same time, the cutting member 42c, which is generally parallel to edge section 42f, parallels the upper section of the side wall of the bucket.

Reinforcing members or gussets 42g and 42h are welded to the wiring member 42c and back plate 42d, as shown, to provide a strong, rigid structure.

C-clamps 28 are welded to the support members 42g and 42h as shown, and another C-clamp is welded to the cutting member 42a. Such clamps enable the ear 42 to be firmly secured to both sections of the side wall of the back-hoe bucket 22, as shown most clearly in FIG. 7 of the drawings.

FIG. 9 of the drawings shows a concretelined ditch or channel which has been formed by a bucket such as that shown in FIG. 7. The main portion of the bucket 22 forms the main portion of the ditch, and the ears 40 and 42 attached to the opposite side walls of the bucket, form or shape the ground along the upper opposite edges of the channel as generally shown at 44. In addition thereto, the upwardly and outwardly slanting cutting edges of the ears 40 and 42 have cleaned the peripheral edges of the ditch, as shown at 46, to prevent the spillage of dirt back into the ditch before and after the ditch has been lined with concrete.

FIG. 10 of the drawings shows a different style of bucket 50 having a pair of opposite side walls or cutting edges which include a first section 50a, a second section 50b and a third section 50c. Whereas the sections 50a and 50c are slanted outwardly and upwardly, the cutting edge 50b is generally vertical. The opposite side of the bucket, of course, is a mirror image of the aforedescribed bucket side wall.

Attached to the opposite sides of the bucket 50 are ears 52 and 54. These ears are similar to the aforedescribed ears 40 and 42, but the back plate as shown at 50d is provided with a different edge configuration for mating with the vertical cutting edge 50b of the bucket. Also, the C-clamp at the cutting edge 50b is disposed at a different angle to accomodate the vertical nature of such cutting edge.

Of particular importance, is the fact that the C-clamps 28 on the ears are positioned approximately four inches behind the forward cutting edges of the cutting members 42a, 42b and 42c. That is, with the C-clamps 28 in place, the ear extends forward of the cutting edge of the bucket 22 by approximately four inches. This feature causes the cutting function of the ears to take place ahead of the cutting operation of the main portion of the back-hoe bucket 22, so that the ground or dirt from the ears flows inwardly to the main bucket area. Thus, even though the ears are relatively shallow (from cutting edge to back plate), they are able to cut continuously without the build-up of loose dirt or ground.

Figure 11:
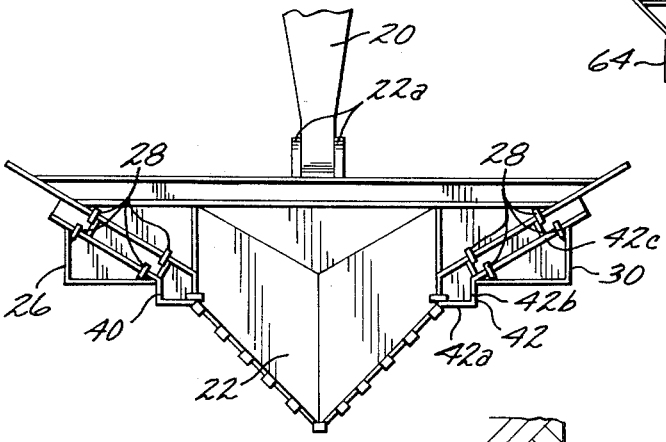
FIG. 11 is a fragmentary elevational view of the device of FIG. 10, further adapted with bolt-on-keys are shown in FIG. 4.

Referring to FIG. 11 of the drawings, there is shown therein a bucket 22 provided with ears 40 and 42 as above-described, and with bolt-on-keys 26 and 30 as shown in FIG. 4. However, in FIG. 11, the bolt-on-keys are firmly secured to the angularly disposed cutting members of the ears as shown in the drawings.

Figure 12:
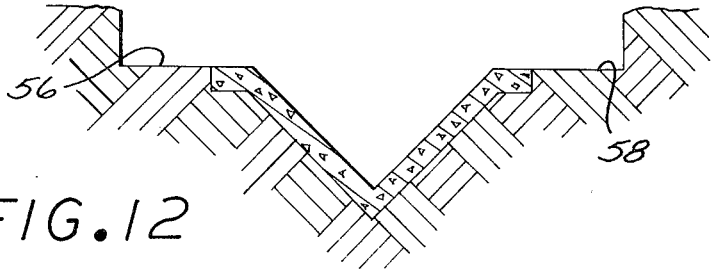
FIG. 12 is a concrete-lined ditch formed by the device of FIG. 11.

FIG. 12 which shows a concrete-lined ditch, shows the type of cut which the structure of FIG. 11 provides. It should be noted that the bolt-on-keys 26 and 30 provide the cleaning cuts 56 and 58, and the lower portion of the ears as well as the main portion of the bucket 22 provide the ditch which is concrete-lined.

Figure 13:
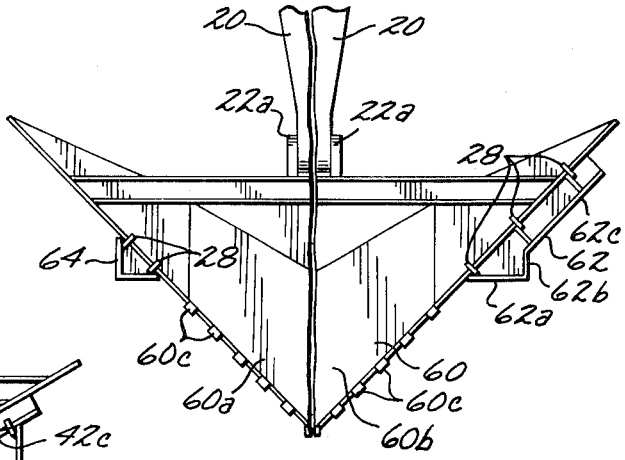
FIG. 13 is a fragmentary elevational view of a straight wall back-hoe bucket adapted with a bolt-on-key and with an ear.

Shown in FIG. 13 of the drawings, is a bucket 60 which is constructed in the same general manner as the aforedescribed bucket 22, but which is provided with relatively straight cutting edges or side walls as shown at 60a and 60b. Such cutting edges may or may not be provided with cutting teeth as shown at 60c.

The straight side back-hoe bucket 60 provides maximum versatility in that substantially any depth or shape of channel or ditch can be provided, with the use of appropriate bolt-on-keys and ears. As for instance, attached to the side 60b of bucket 60 is a movable ear 62 which can be secured to the cutting edge 60b in any position whatever along the length thereof.

Figure 14:
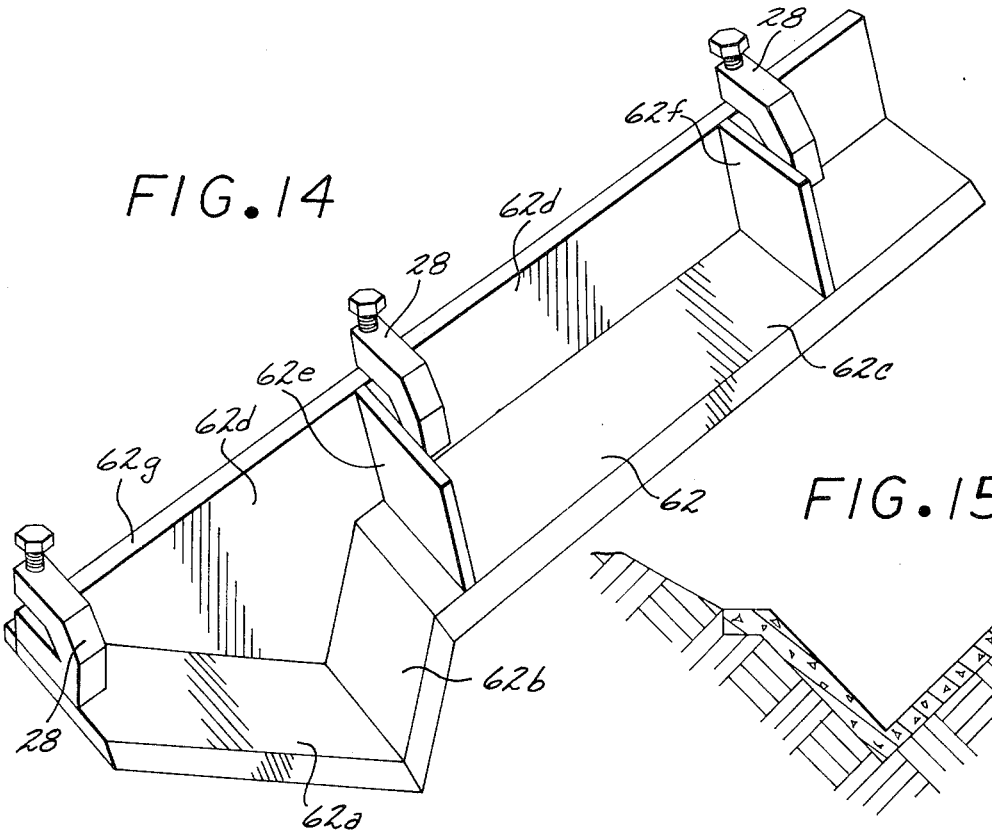
FIG. 14 is a perspective view of an ear shown in FIG. 13.

As shown in FIG. 14, ear 62 comprises cutting members 62a, 62b and 62c as well as back plate 62d and reinforcing support members 62e and 62f. The back plate 62d, it will be noted, has a single mating edge 62g to fit against the side wall of bucket 60 regardless of where the ear 62 is positioned. C-clamps 28 are positioned appropriately so as to be secured to the cutting edge of the bucket 60, with the cutting edge of the members 62*a*, 62*b* and 62*c* approximately four inches forward of the cutting edge of the bucket.

Figure 15:
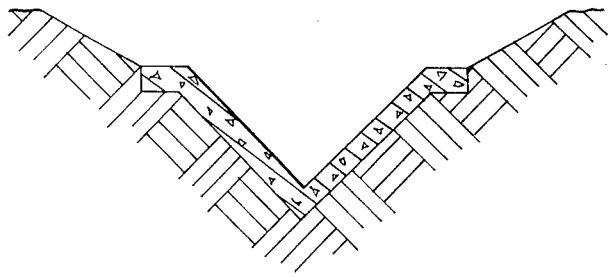
FIG. 15 is a cross-sectional view of a concrete-lined ditch formed by one of the devices of FIG. 13.

The concrete-lined ditch of FIG. 15 is provided with the bucket 60 with a pair of ears 62 on opposite sides thereof. The upper reaches of the ears would effect cleaning of the ditch to prevent dirt and the like from falling into the ditch before or after it is lined with concrete.

FIG. 13 further shows a bolt-on-key 64 secured to the side wall 60*a*. Such key 64 can also be positioned as desired along the length of the side wall 60*a*. Further, such bolt-on-key 64 may be provided on the ear 62 to provide greater versatility in providing the desired channel.

Although I have shown and described certain specific embodiments of my invention, I am well aware that many modifications thereof are possible. The appended claims are not to be restricted except insofar as it is necessitated by the prior art.

I claim:

1. A detachable ground-shaping system for use with a back-hoe bucket, comprising in combination, a main body formed with at least two ground-cutting members and a back plate engaging each of said ground-cutting members along the length thereof, and a pair of clamps fixed to said main body to be firmly secured to said bucket to retain said back plate there against throughout its length.

2. A detachable groundshaping system for use with a back-hoe bucket according to claim 1, wherein said back plate is firmly secured to said cutting members and throughout its length is formed complementally of a portion of a back-hoe bucket whereby said back plate is caused to be retained against said bucket throughout the length of said back plate.

3. A detachable ground-shaping system for use with a back-hoe bucket according to claim 2, wherein said system is adapted to be attached to a slanting side wall of a back-hoe bucket, said cutting members being disposed at right angles to each other and said back plate being formed with an angularly disposed edge which is formed complementally of a portion of said slanting side wall and causes said cutting members to be substantially horizontal and vertical when said clamps engage said side wall, said cutting members and said slanting side wall forming a closed triangle in engagement with said back plate.

4. A detachable ground-shaping system for use with a back-hoe bucket having at least one slanting side wall comprising in combination, a main body formed with at least three ground-cutting members and a back plate engaging each of said ground-cutting members along the length thereof, said back plate being formed to have an edge engagable with said slanting side wall of said bucket, and a pair of clamps fixed to said main body to be firmly secured to said bucket to retain said back plate against said slanting side wall throughout the length of said back plate and to dispose one of said ground-cutting members in a horizontal position while another of said ground-cutting members is in a vertical position.

5. A detachable ground-shaping system for use with a back-hoe bucket according to claim 4, wherein said third cutting member is connected to said vertical member along a line spaced from the connection between said horizontal and vertical members.

6. A detachable ground-shaping system for use with a back-hoe bucket according to claim 5, wherein said system is adapted to be attached to the side wall of a back-hoe bucket having two slanting wall sections disposed at an angle to each other, said third cutting member being disposed parallel to but spaced from one of said wall sections and the horizontal one of said first two members being adapted to engage the other of said wall sections.

7. A detachable ground-shaping system for use with a back-hoe bucket according to claim 6, wherein said back plate is formed with two edges disposed at an angle to each other for mating engagement respectively with said wall sections of said back-hoe bucket.

* * * * *